US010260224B1

(12) United States Patent
Jazzar

(10) Patent No.: US 10,260,224 B1
(45) Date of Patent: Apr. 16, 2019

(54) SIMPLIFIED PRECAST CONCRETE SYSTEM WITH RAPID ASSEMBLY FORMWORK

(71) Applicant: Mohammad Omar A. Jazzar, Clearwater, FL (US)

(72) Inventor: Mohammad Omar A. Jazzar, Clearwater, FL (US)

( * ) Notice: Subject to any disclaimer, the term of this patent is extended or adjusted under 35 U.S.C. 154(b) by 0 days.

(21) Appl. No.: 16/122,064

(22) Filed: Sep. 5, 2018

Related U.S. Application Data

(63) Continuation-in-part of application No. 15/858,589, filed on Dec. 29, 2017, now Pat. No. 10,094,101.

(51) Int. Cl.
*E04B 1/20* (2006.01)
*E04B 1/16* (2006.01)

(52) U.S. Cl.
CPC ..... *E04B 1/164* (2013.01); *E04B 2103/02* (2013.01)

(58) Field of Classification Search
CPC ..... E04B 1/04; E04B 1/20; E04B 5/04; E04B 5/32; E04B 5/38; E04B 2103/02; E04B 2005/322; E04C 2/06; E04C 2/50; E04C 2/044; E04C 3/34; E04G 11/36; B28B 1/14; B28B 1/16
USPC ..... 52/236.3, 236.5, 236.8, 252, 249, 260, 52/283, 741.14, 745.13; 264/34, 35
See application file for complete search history.

(56) References Cited

U.S. PATENT DOCUMENTS 938,458 A * 11/1909 Brockhausen ..... E04B 5/43 256/19
1,380,324 A * 5/1921 Piggins ..... E04B 1/215 52/236.7
1,496,819 A * 6/1924 Mitchell ..... B28B 23/18 264/269
2,720,017 A * 10/1955 Youtz ..... E04B 1/35 264/34
2,871,544 A * 2/1959 Youtz ..... E04B 1/35 249/23
3,354,593 A * 11/1967 Zukas ..... E04B 1/21 52/125.1
3,490,191 A * 1/1970 Ekblom ..... E04B 1/20 52/125.1
3,524,293 A * 8/1970 Leyten ..... E04B 1/161 249/19

(Continued)

*Primary Examiner* — Charles A Fox
*Assistant Examiner* — James J Buckle, Jr.
(74) *Attorney, Agent, or Firm* — Larson & Larson, P.A.; Justin P. Miller; Frank Liebenow

(57) ABSTRACT

The disclosed system divides the precast and cast-in-place construction into vertical and horizontal components. The vertical components are precast, permitting rapid vertical building construction without a delay for concrete to set. The three primary precast components are a column, a horizontal slab, and a central panel placed diagonally between the slabs.

By separating the columns from the horizontal slabs, the molds required to precast are simplified and transportation of the precast elements is streamlined. The resulting precast components are also of a weight and size that is readily manageable using a standard construction crane.

The horizontal components are a combination of cast-in-place, and precast components. The result creates a continuous unitary floor structure that carries larger loads with less thickness that purely simple span pre-cast construction.

11 Claims, 19 Drawing Sheets

(56) References Cited

U.S. PATENT DOCUMENTS 3,613,325 A * 10/1971 Yee ..... E04B 1/20 52/236.8
4,081,935 A * 4/1978 Wise ..... E04B 1/21 52/236.8
4,409,764 A * 10/1983 Wilnau ..... E04B 1/165 52/127.3
5,367,854 A * 11/1994 Kim ..... E04G 21/06 264/426
5,507,124 A * 4/1996 Tadros ..... E04B 5/43 52/251
5,787,663 A * 8/1998 Wehrmann ..... E04B 5/14 403/217
5,809,712 A * 9/1998 Sinnanjuntak ..... E04C 5/08 52/223.7
5,845,457 A * 12/1998 Wybauw ..... B28B 7/0064 52/745.2
7,121,061 B2 10/2006 Jazzar
8,011,147 B2 * 9/2011 Hanlan ..... E04B 1/20 52/236.3
8,549,805 B2 * 10/2013 Kim ..... E04C 5/0645 52/253
8,844,223 B2 * 9/2014 Zhong ..... E04B 1/161 52/259
9,371,648 B1 * 6/2016 Tikhovskiy ..... E04B 5/18
9,683,361 B2 * 6/2017 Timberlake ..... E04C 5/0604
2001/0003234 A1 * 6/2001 Van Doren ..... E04B 1/165 52/251
2005/0210762 A1 * 9/2005 Broberg ..... E04B 1/34807 52/79.1
2010/0024332 A1 * 2/2010 Valaire ..... E04B 5/38 52/252
2011/0131908 A1 * 6/2011 Lee ..... E04B 1/04 52/283
2013/0074430 A1 * 3/2013 Morcous ..... E04B 5/16 52/252
2016/0122996 A1 * 5/2016 Timberlake ..... E04C 5/0604 52/236.3

* cited by examiner

SIMPLIFIED PRECAST CONCRETE SYSTEM WITH RAPID ASSEMBLY FORMWORK

CROSS-REFERENCE TO RELATED APPLICATION

This application is continuation-in-part of U.S. patent application Ser. No. 15/858,589, filed Dec. 29, 2017, titled Precast Concrete System with Rapid Assembly Formwork.

FIELD

This invention relates to the field of building construction and more particularly to a system for the rapid construction of buildings using a hybrid mix of precast and poured concrete construction.

BACKGROUND

The construction material of choice for modern multi-story structures is concrete. A durable material, and readily available around the world, it can be used to form floors, walls, and columns that eventually result in a complete building.

Conventional cast-in-place concrete construction relies on the use of labor-intensive, time-consuming, bulky, built-in-place formwork that must be erected for each wall and column. The formwork takes up space that could be used for moving around the site in the floor below, and does so for the duration of the construction. This process alone is time-consuming. After the formwork is placed, concrete is poured within the forms. This concrete is allowed to partially cure, then the formwork is removed and after twenty-eight days, the concrete can bear its full load. The result of these delays is the slow the speed of construction.

Given the time-consuming nature of cast-in-place concrete, the concept of casting off-site arose, with the pre-cast concrete pieces then being assembled on-site. While moving the slow and time-consuming process of pouring concrete and wait for cure, to an off-site location, does speed up the process of construction, the resulting structure lacked the strength of a cast-in-place building due to weak connectivity. Additionally, because the pre-cast concrete must be transported to the construction site, the panel size is limited. The result is a building made from many separate panels that fail to transfer loads to adjacent bays as in the case of poured-in-place structures.

What is needed is a system for constructing a building that combines the strength and continuity of cast-in-place construction with the rapid assembly of precast construction, thus maintaining structural continuity between bays and floors by redistributing stresses to adjacent bays, while simplifying the process of casting the pre-cast pieces and reducing the transportation requirements of the resulting pieces.

SUMMARY

The disclosed system divides the precast and cast-in-place construction into vertical and horizontal components. The vertical components are precast, permitting rapid building construction without a delay for concrete to set and gain strength.

There are two embodiments of the disclosed system.

The first embodiment uses only two precast components: a column that includes a slab portion, and a central panel placed diagonally between four columns. Each precast component is a weight and size that is readily manageable using a standard construction crane.

The second embodiment uses three precast components: a column, a separate slab portion, and a central panel placed between sets of four columns. Separating the column from the slab eases the casting process and simplifies transportation.

The horizontal components of both embodiments are a combination of cast-in-place and precast components. The resulting structure has a unitary floor structure that carries larger loads with less thickness that purely pre-cast construction.

The horizontal components that require vertical support during the curing process are either supported using temporary means, or rested upon the precast slabs, which are in turn held up by the precast column. Any temporary structure is easily erected by hand.

Given that the building can be assembled with vertical components that have already gained strength, and thus can be stressed, the cast-in-place concrete is permitted to cure without resulting delays in construction.

The resulting structure can be erected as quickly as the crane can pick and place the components. For example, a ten-story structure can be assembled in two weeks.

The disclosed combination of pre-cast and cast-in-place elements maintains the quick erection of a pre-cast system, with the improved strength of a cast-in-place system.

Existing systems use pre-cast panels that are formed in a factory. Precast pieces are made by:

- Cutting, bending, and connecting rebar to form an internal reinforcement;
- Surrounding the rebar with a form;
- Filling the form with concrete;
- Permitting the concrete to cure; and
- Removing the cast piece from the form.

While the resulting pieces may be quickly assembled on-site, the pre-cast pieces remain as individual pieces. As a result, any applied bending moment does not cross to adjacent pre-cast pieces. Thus, the moments are concentrated in shorter spans, rather than being spread and redistributed across greater lengths.

The difference in strength between pre-cast and cast-in-place is a significant 1.5 times:

Moment calculation for standard precast system:

$$M = \frac{1}{8}WL^2$$

Moment calculation for disclosed system with joined span:

$$M = \frac{1}{12}WL^2$$

Reducing the moments requires joining the beams across the length and width of the building. If the beams act as a unitary structure, the resulting beams can be thinner while maintaining the same strength. The result is a finished building with a greater number of stories than an equivalent purely pre-cast structure due to a reduction in both beam and slab depth.

The reduction in weight also reduces column and foundation sizing,

Turning now to the pieces that make up the structure: The system is divided into permanent structure, or pre-cast pieces, and temporary structure, or formwork.

The First Embodiment

The permanent structure of the first embodiment is comprised of two primary pre-cast pieces—a central member and a spanning member.

The central member includes a vertical column that is optionally divided by a horizontal slab. Rebar runs end-to-end through the horizontal slab, protruding from all sides. This rebar is later incorporated into the cast-in-place platforms that surround the central horizontal panel where it always overlaps with the incoming steel sufficiently to create a continuous moment bond.

The edges of the horizontal slab are stepped with the lower face offset 15 cm inward.

The vertical column includes steel bars that, using threaded rod and protracted nuts, act to connect each column to its neighboring columns both above and below. Optionally included within the upper and lower faces of the columns are one or more centered keys, used both as shear keys and to ease placement of columns above.

Turning to the spanning member of the first embodiment, it is a substantially square or rectangular slab. The spanning member is intended to be placed diagonally between central members in a horizontal plane. Substantial portions of the spanning member include empty cavities, making the upper surface look like a waffle. The empty spaces lighten the spanning member, making each panel much lighter and placement less difficult. The empty chambers are later filled with concrete, or alternatively filled with foam or other low-density material.

The top seven centimeters of the empty chambers forming the floor slab are optionally filled in prior to, or during, construction using a low-density material. For example, extruded polystyrene foam, or a similar material. The low-density material is then covered with concrete prior to, or during, construction. By building the spanning member from a lightweight core surrounded by concrete, weight is reduced while the majority of strength is maintained. The cavities are tapered inward to act as a sub-form, restraining the concrete from falling.

The empty chambers are preferably tapered from top to bottom.

The center of the spanning member between the empty cavities is solid—lacking cavities. The solid portion permits support of a collapsible tower. The collapsible towers permit each spanning member to support the spanning members placed above.

Rebar exits the edges of the spanning member, both from the upper portion of the stepped edge and the lower portion.

The second embodiment divides the vertical precast member into two pieces, easing the process of casting and transportation. The ultimate strength of the building is also improved due to increased rebar length, which in turn lowers the required quantity of rebar and thus reduces cost.

The Second Embodiment

The second embodiment disclosed separates the vertical column member into a precast column and a precast slab. Separating the column from the slab simplifies the process of casting the members by reducing the complexity of the shapes. The resulting shapes are also more readily transportable because overall height is reduced and the shapes are easily stacked on trucks and trains.

The precast slab has upper and lower rebar. The lower rebar is precast into place, protruding from all sides. This lower rebar is later incorporated into the cast-in-place platforms that surround the central horizontal panel where it always overlaps with the incoming steel sufficiently to create a continuous moment bond.

The upper rebar of the precast slab is placed during construction. This allows the upper rebar to be as long as commercially available, reducing waste and increasing strength.

The precast slab was lightened by reducing its thickness to approximately one-third of the overall final thickness. The reduction in thickness creates the additional benefit of leaving room for the upper layer of rebar to continue across the slab, rather than requiring an overlap joint. The result is a reduction in the total amount of rebar required, and increasing the rebar lengths. Increasing the length increases the overall strength of the structure.

The laid-in rebar is tied to the stirrups that protrude upward from the precast slab. The laid-in rebar is connected to the spanning member, which is discussed further below.

The precast slab includes an upwardly-protruding foot to permit additional columns to be placed immediately. The foot includes spaced-apart risers. The column for the next floor rests upon the risers. The threaded rebar or rods pass through holes in the risers, structurally connecting the columns. As construction continues upward, laid-in upper rebar is passed between the risers.

Turning to the precast column of the second embodiment, the column includes threaded rod, or threaded rebar, and nuts or couplings to connect each column to its neighboring columns above and below.

A steel plate at the bottom of each precast column includes four holes that allow the threaded rods from the column below to pass through.

Stirrups are optionally included in the precast slab, the stirrups acting to tie the precast to the cast-in-place concrete.

Optionally, the columns and slabs are combined, but a passage is left for the passage of rebar through the lower portion of the column, just above where it meets the slab.

Turning to the precast spanning member, it is a substantially square or rectangular slab. The spanning member is placed diagonally between central members in a horizontal plane. Substantial portions of the spanning member include empty cavities, making the upper surface look like a waffle.

The empty chambers of the spanning member are optionally filled in prior to, or during, construction using a low-density material. For example, extruded polystyrene foam, or a similar material. The low-density material is then covered with concrete prior to, or during, construction.

The precast sections of the spanning member optionally include stirrups that protrude upward. The stirrups are tied to upper rebar, further strengthening the connection between the precast and cast-in-place concrete.

In the preferred embodiment, the lower rebar of the spanning member is placed during casting.

Alternatively, the precast sections of the spanning member include penetrations for rebar installation. This permits rebar installation after installation of the spanning member, the rebar later grouted into place.

Rebar exits the edges of the spanning member, both from the upper portion of the stepped edge and the lower portion.

The precast spanning member of the second embodiment rests upon the precast slab, and thus does not require the use of a temporary tower during construction.

Formwork and Assembly

Turning to the formwork and erection system, it is comprised of two primary parts: A collapsible tower for supporting successive waffle pieces of the first embodiment; and a panel that is hung and rotated into place, creating the only formwork between the waffles and central column vertical slabs.

An explanation of the construction process will aid an understanding of how the formwork and erection system work with the pre-cast pieces to result in the desired structure.

The first step to erecting a structure using the disclosed system is to excavate to a depth sufficient for placement of the base columns.

Next, the base columns are installed, with the flat horizontal slab of each resting against the excavated surface.

Next, if using the first embodiment, a subsequent layer of central members is placed, each central member resting on a base column.

If using the second embodiment, a layer of precast columns is placed, which are then topped by precast slabs.

Optionally, a base slab is poured that fixes the base columns in place and presents a flat surface for placement of the collapsible towers.

Next, if using the first embodiment, a collapsible tower is placed in the center of each set of four columns. Each collapsible tower includes locating pins that protrude from its top to help locate the spanning member placed above.

Then, for the first embodiment, a spanning member is placed on top of the collapsible tower. The locating pins of the collapsible tower fit within penetrations of the spanning member, and are temporarily bolted in place.

For the second embodiment, a spanning member is placed between sets of precast slabs, with the spanning member resting upon the precast slabs.

Hanging beneath each edge of each spanning member are formwork support rods.

Next, the rotating formwork panels are hooked to their respective formwork support rods, then rotated upward into place. The slideable support brackets are moved into place, latching into gaps between the formwork support rod and the spanning member.

The outer edges lack spanning members, and thus lack formwork support rods. In order to hold the rotating formwork panels in place, temporary trusses or stilts are placed between the central members along the edge.

With the formwork placed, rebar, wiring, and other utilities are placed as needed.

Then the spaces within the precast spanning member, as well as between the spanning members and the central members, are filled with concrete.

Construction can nearly immediately move to the next floor. The collapsible towers are placed and spanning members set, then moving on to more formwork.

Generally, after three subsequent floors are placed and poured, the first set of formwork can be removed and moved up to the top floor. This rotation progress upward until the building reaches its desired height.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
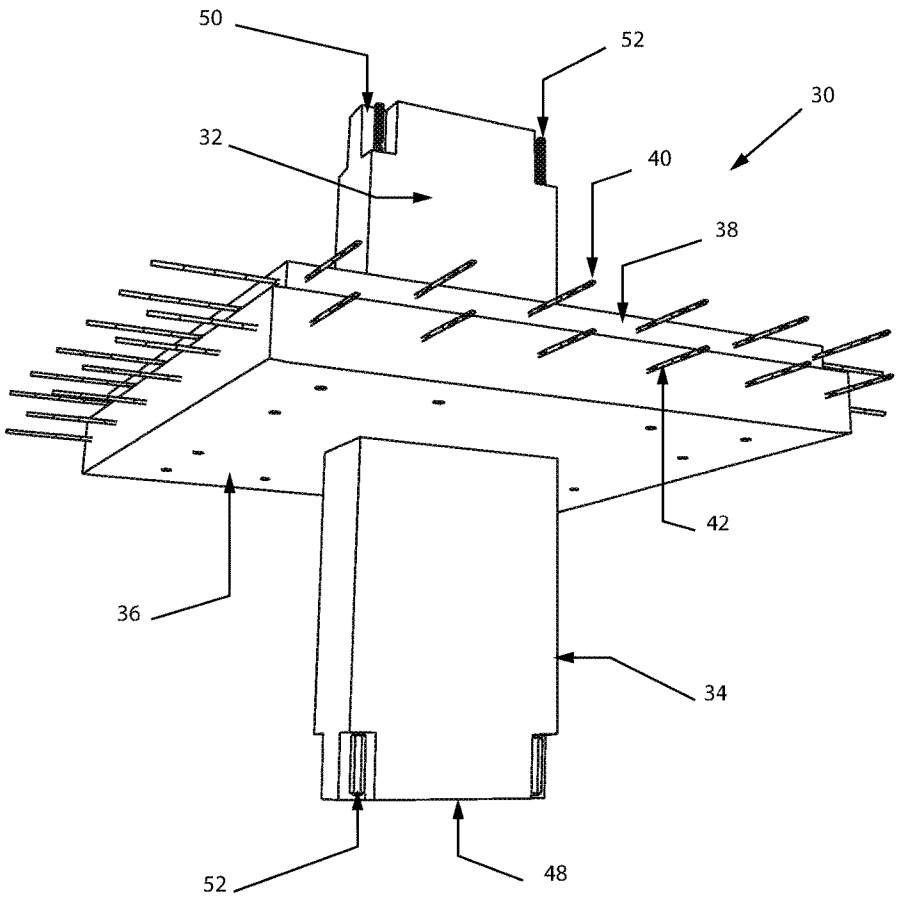
FIG. 1 illustrates a view of an embodiment of the central member.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a view of an embodiment of the central member is shown. The central member 30 is formed from an upper column portion 32 and a lower column portion 34, with a dividing slab 36 placed between.

A perimeter notch 38 follows the edge of the dividing slab 36. Protruding from the edge of the dividing slab 36 are continuous central member upper rebar 40 and continuous central member lower rebar 42.

Hidden is the shear key 48 used to connect the central member 30 to the columns above or below itself.

Along the bottom and top corners are the corner connection cutouts 50, which make room for the column vertical rods 52. Their use is discussed further below.

The dividing slab 36 may be located at other positions with respect to the central member 30, and thus need not be centered top-to-bottom. The building design may necessitate placement of the dividing slab 36 at points such as the bottom of the central member 30, top of the central member 30, or at other locations between.

Figure 2:
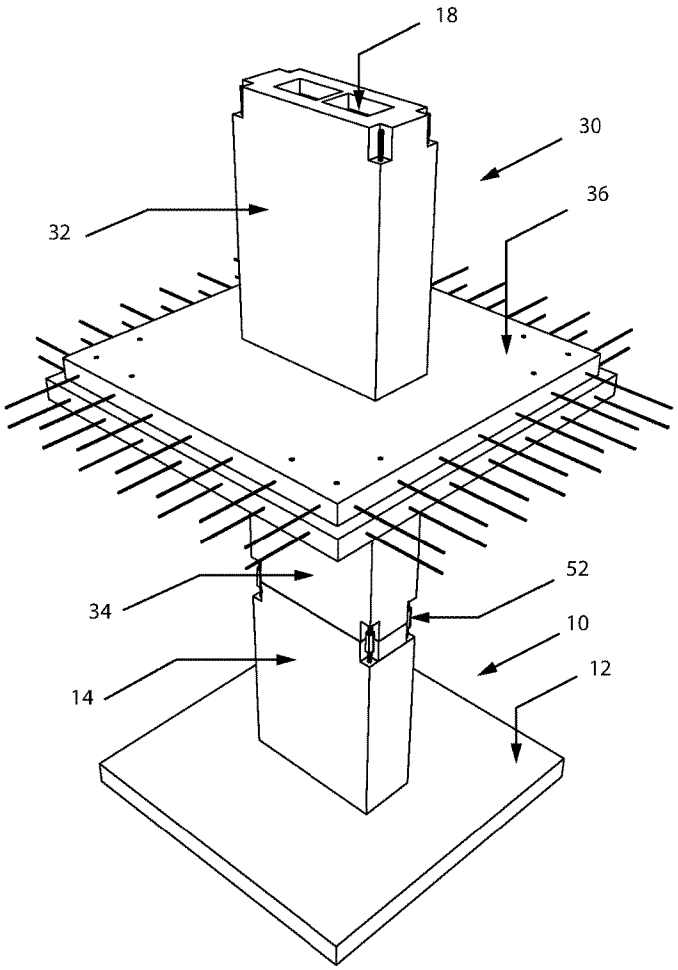
FIG. 2 illustrates a view of an embodiment of the central member placed atop a base member.

Referring to FIG. 2, a view of an embodiment of the central member placed atop a base member is shown.

A central member 30 is shown placed atop a base member 10, which is formed from a base slab 12 and vertical base rectangular column 14. The column vertical rods 52 are connected to each other, locking the lower column portion 34 to the base rectangular column 14 to prevent uplift.

Figure 3:
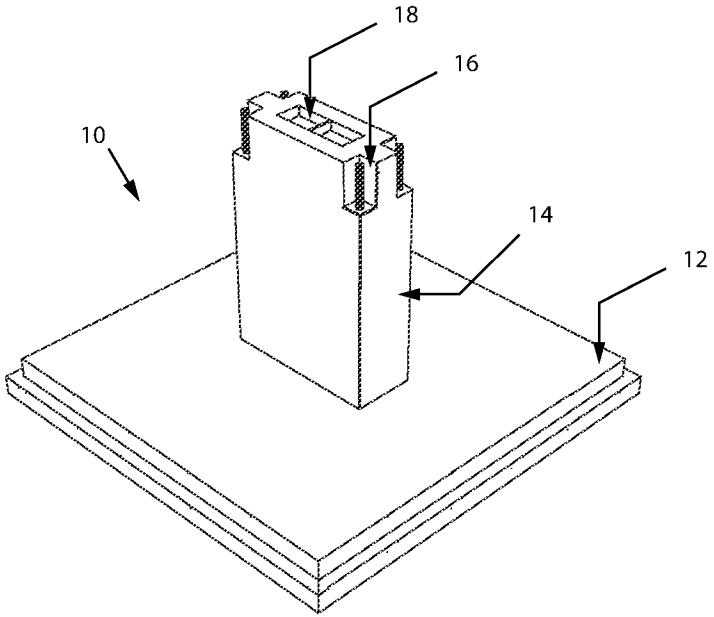
FIG. 3 illustrates an embodiment of a base member.

Referring to FIG. 3, an embodiment of a base member is shown.

The base member 10 includes a base slab 12 and base rectangular column 14. A corner threaded rod 16 is placed on the corners of the base rectangular column.

One or more shear key receiving cavities 18 aid in placement of upper columns and help to prevent twisting.

Figure 4:
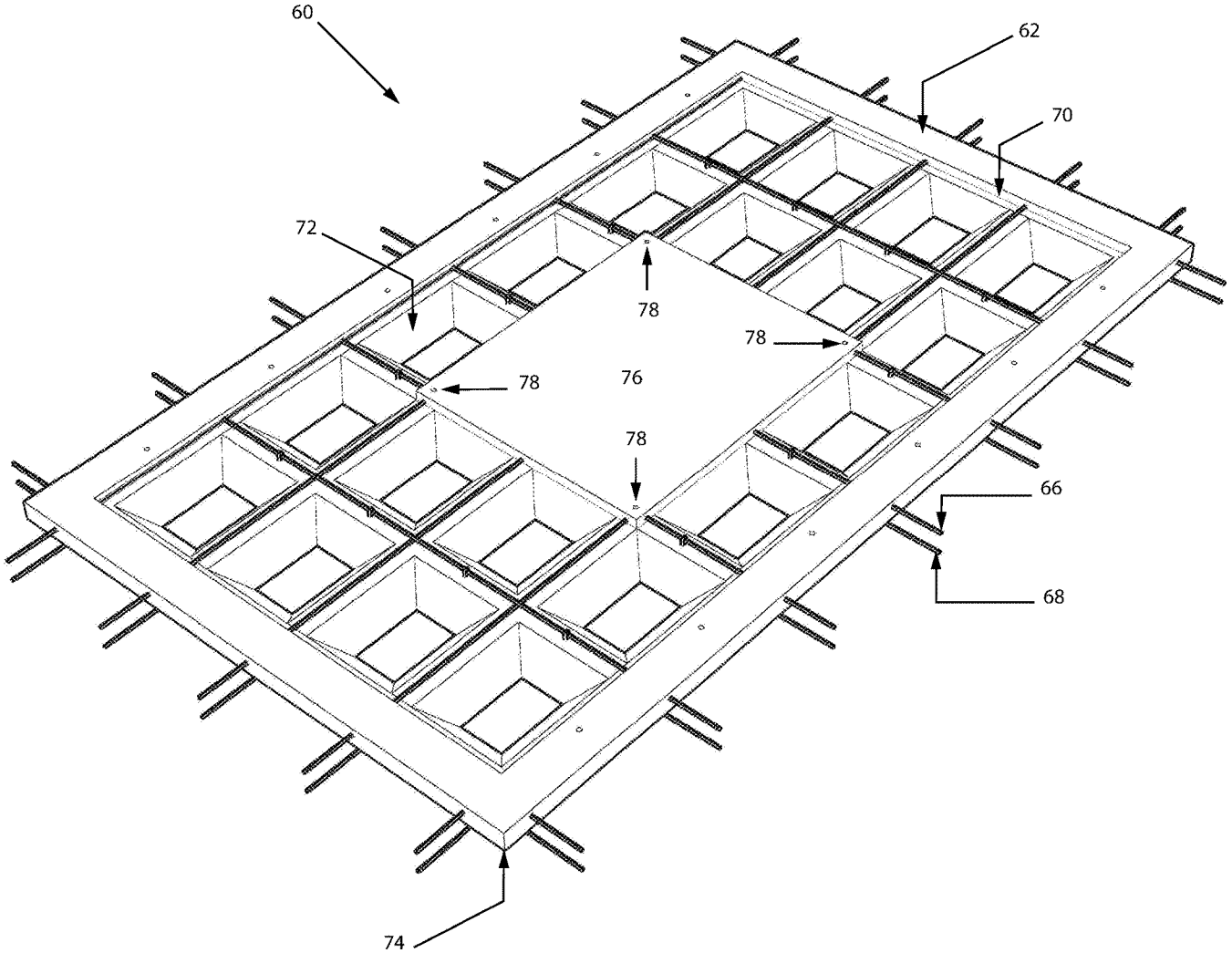
FIG. 4 illustrates an embodiment of a spanning member.

Referring to FIG. 4, an embodiment of a spanning member is shown.

The spanning member 60 includes a perimeter wall 62 that bounds a central cavity 70. The central cavity 70 is divided into a multiplicity of individual cavities 72 that are later filled with concrete.

The individual cavities 72 are optionally filled with a plug of lightweight material before being covered with concrete. For example, an expanded foam may be used, then covered with a concrete layer. Or a concrete that is lightweight, either by using a lightweight mix or a novel type of concrete, such as autoclaved aerated concrete, may be used. The result is a lightweight spanning member 60 that maintains the majority of its strength.

Continuous spanning member upper rebar 66 and continuous spanning member lower rebar 68 are shown protruding above and below the inverted perimeter notch 74.

A central supporting face 76 is pre-formed, later used to support a collapsible tower (not shown). The pin penetrations 78 will interface with locating pins of the collapsible tower to aid in proper placement of the spanning member 60.

Figure 5:
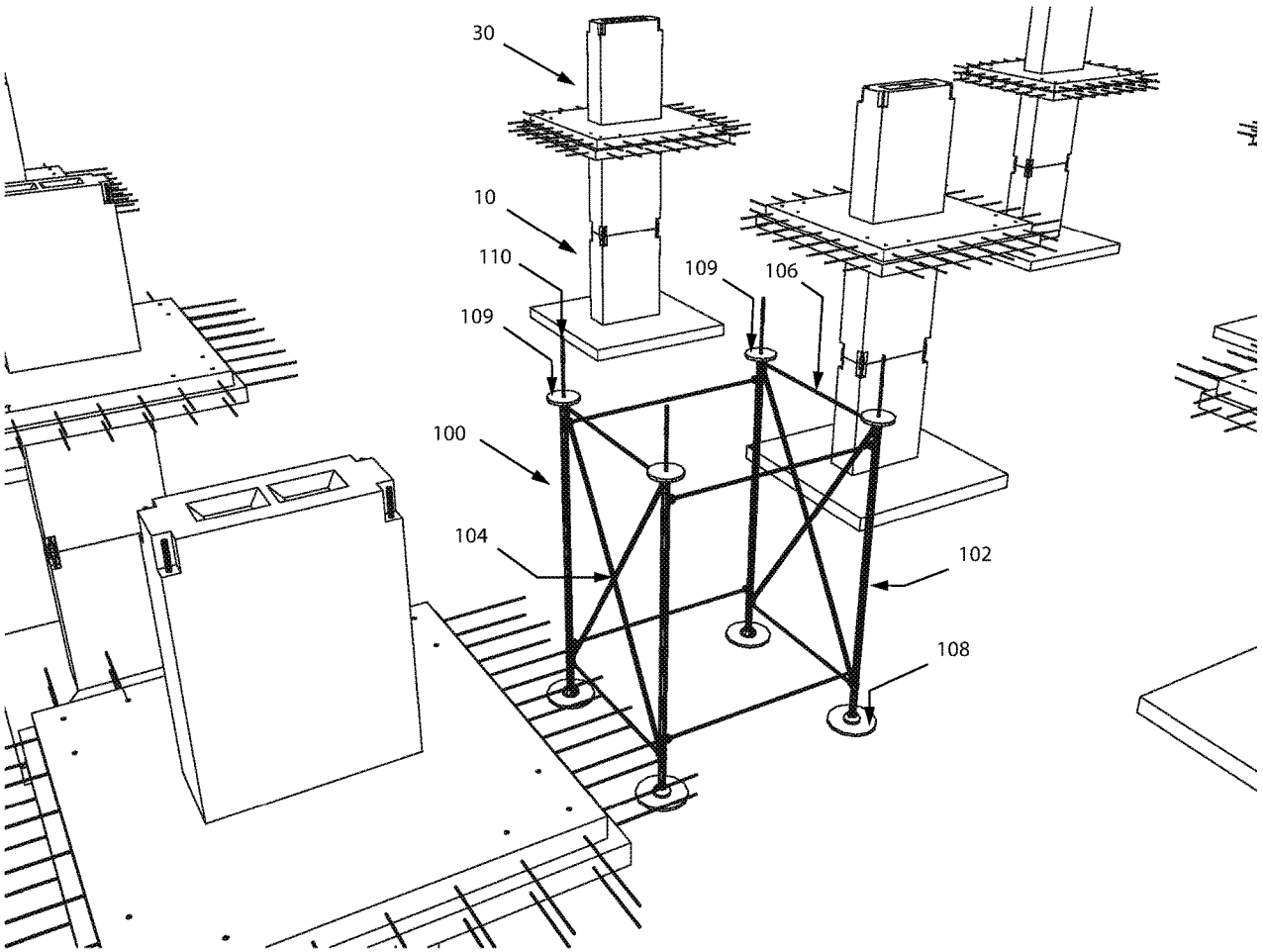
FIG. 5 illustrates an embodiment of a collapsible tower placed between base members.

Referring to FIG. 5, an embodiment of a collapsible tower placed between base members is shown.

The collapsible tower 100 is preferably formed from four posts 102, held in position by cross braces 104 and horizontal braces 106. At the bottom of each post 102 is a base plate 108. At the upper end of each post 102 is a top plate 109. Protruding beyond the top plate 109 is a locating pin 110, which will interface with the pin penetrations 78 of the spanning member 60 (not shown).

Figure 6:
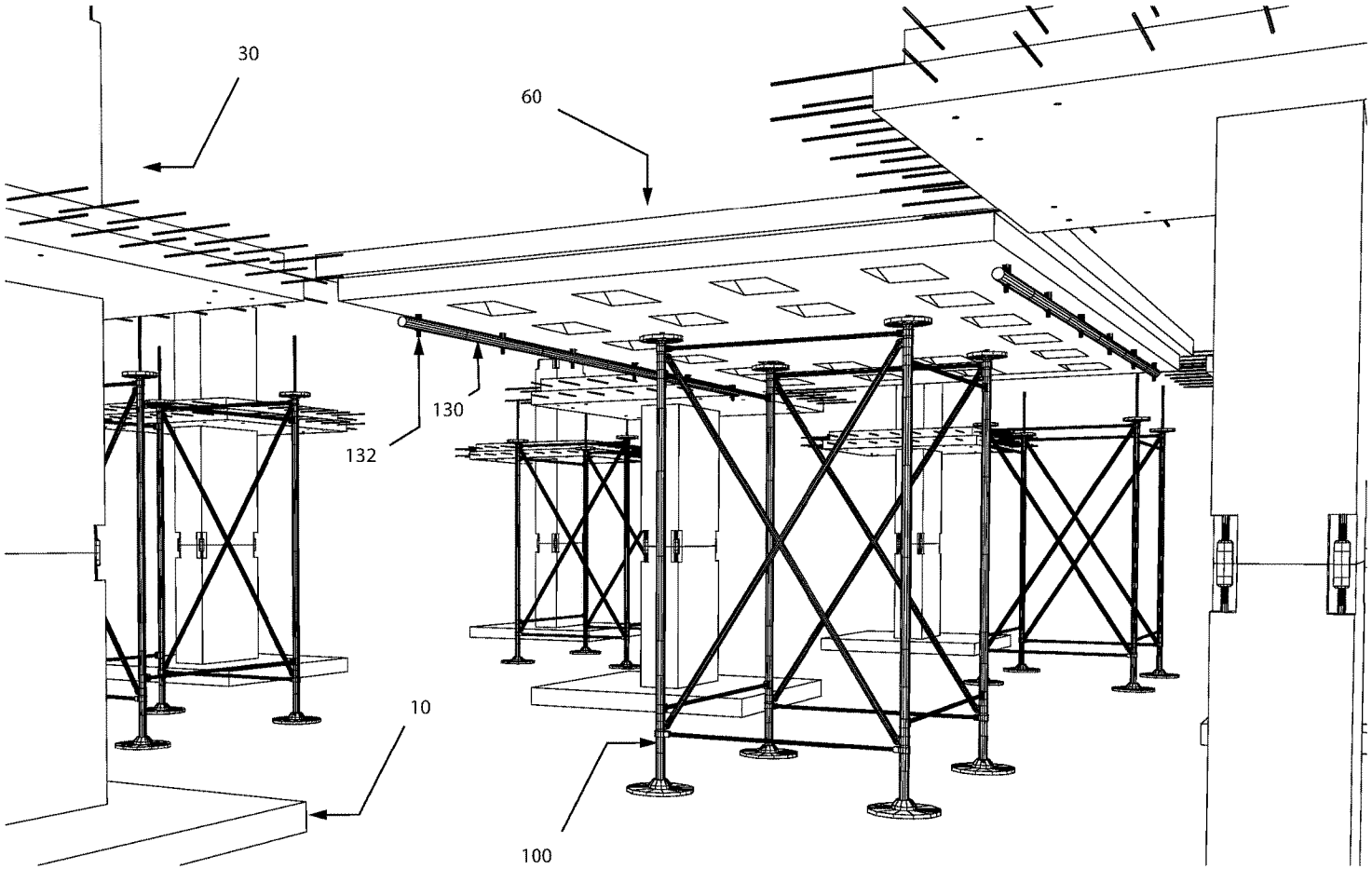
FIG. 6 illustrates an embodiment supporting a spanning member.

Referring to FIG. 6, an embodiment supporting a spanning member is shown.

The spanning member 60 is shown placed atop a collapsible tower 100. Along each edge is a formwork support rods 130, held to the spanning member by fasteners 132.

Figure 7:
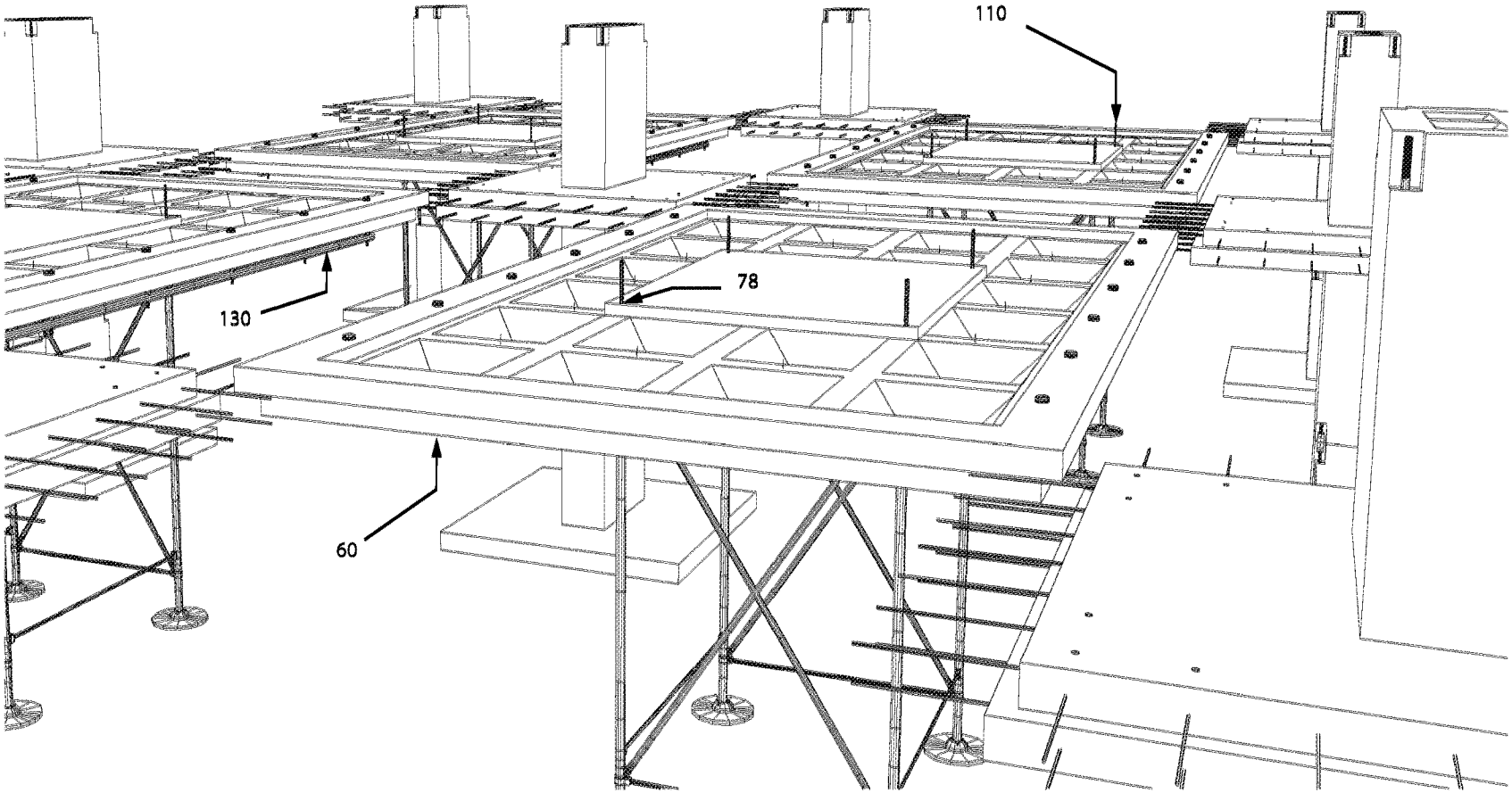
FIG. 7 illustrates the locating pins of the collapsible tower penetrating a spanning member.

Referring to FIG. 7, the locating pins of the collapsible tower penetrating a spanning member is shown.

This topside view of the spanning member 60 shows the locating pins 110 protruding through the pin penetrations 78, aiding placement of the spanning member 60. Furthermore, the subsequent collapsible tower 100 (not shown) is placed on top of the locating pins 110 to maintain alignment as the structure grows higher.

Figure 8:
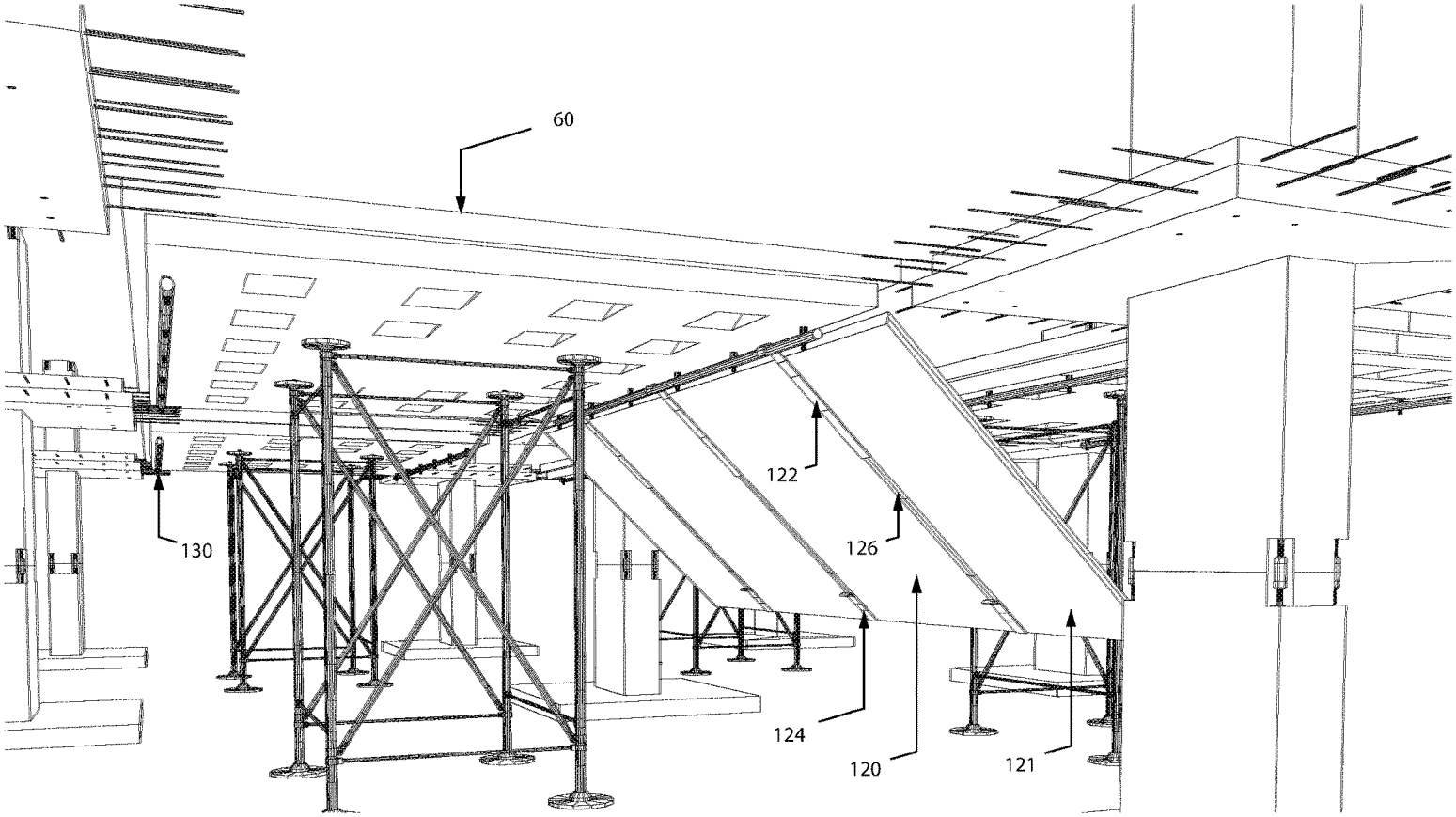
FIG. 8 illustrates an embodiment of the rotating formwork, hanging from a spanning member.

Referring to FIG. 8, an embodiment of the rotating formwork, hanging from a spanning member, is shown.

A rotating formwork panel 120 is shown with its fixed hooks 122 rotating above the formwork support rod 130 attached to the spanning member 60. The solid panel 121 will support the concrete that will be poured above. One or more optional stiffeners 126 increase the rigidity of the rotating formwork panel 120 to support the weight of the concrete. The slideable hooks 124 are shown hanging from the rotating formwork panel 120, not yet in a position to provide support.

Figure 9:
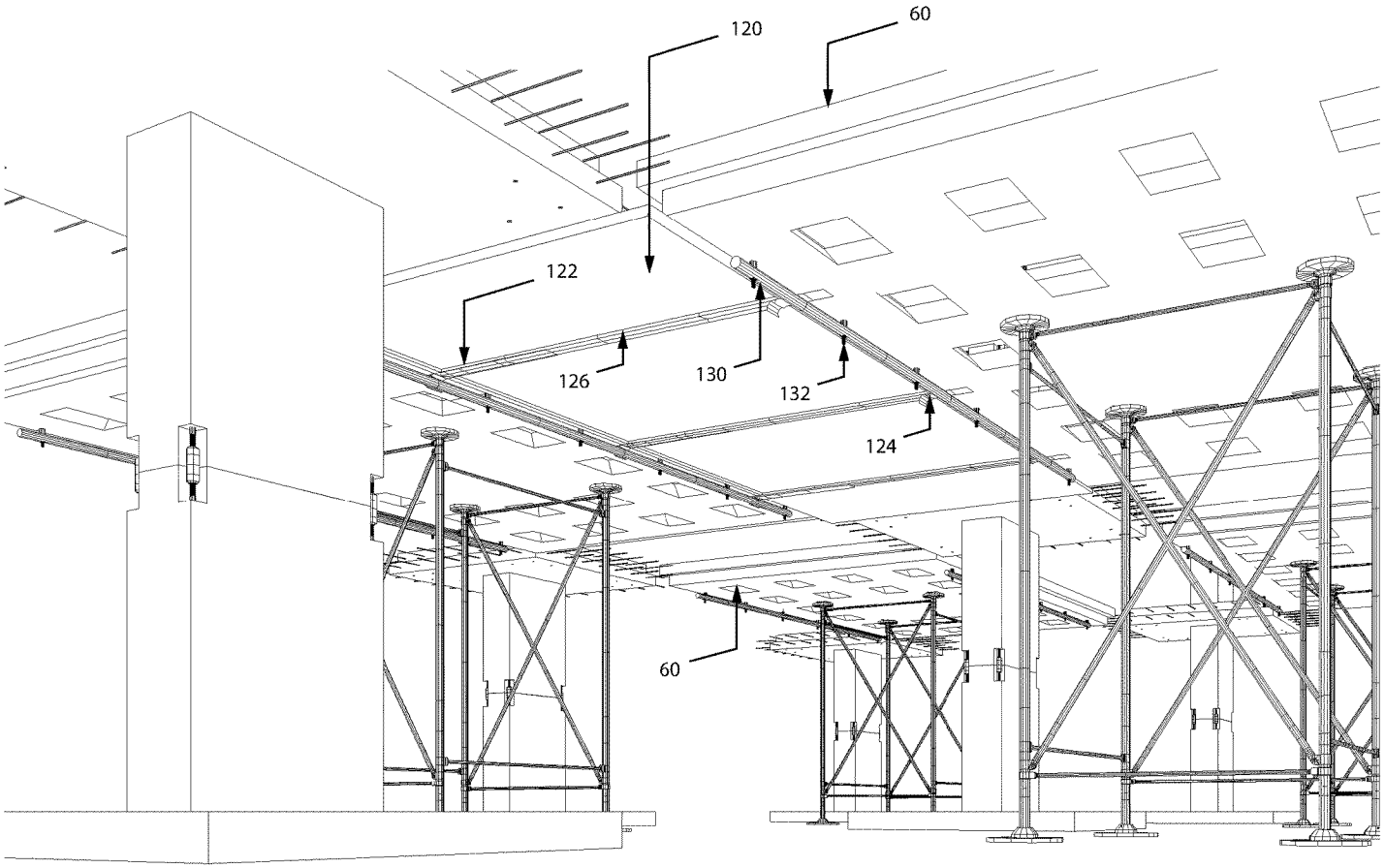
FIG. 9 illustrates an embodiment of the rotating formwork, hanging between spanning members.

Referring to FIG. 9, an embodiment of the rotating formwork, hanging between spanning members, is shown.

The rotating formwork panel 120 is now supported along both edges, with the fixed hooks 122 providing support along one edge, and the slideable hooks 124 inserted between the spanning member 60 and formwork support rod 130. The formwork panel 120 is now ready to support pour concrete.

Figure 10:
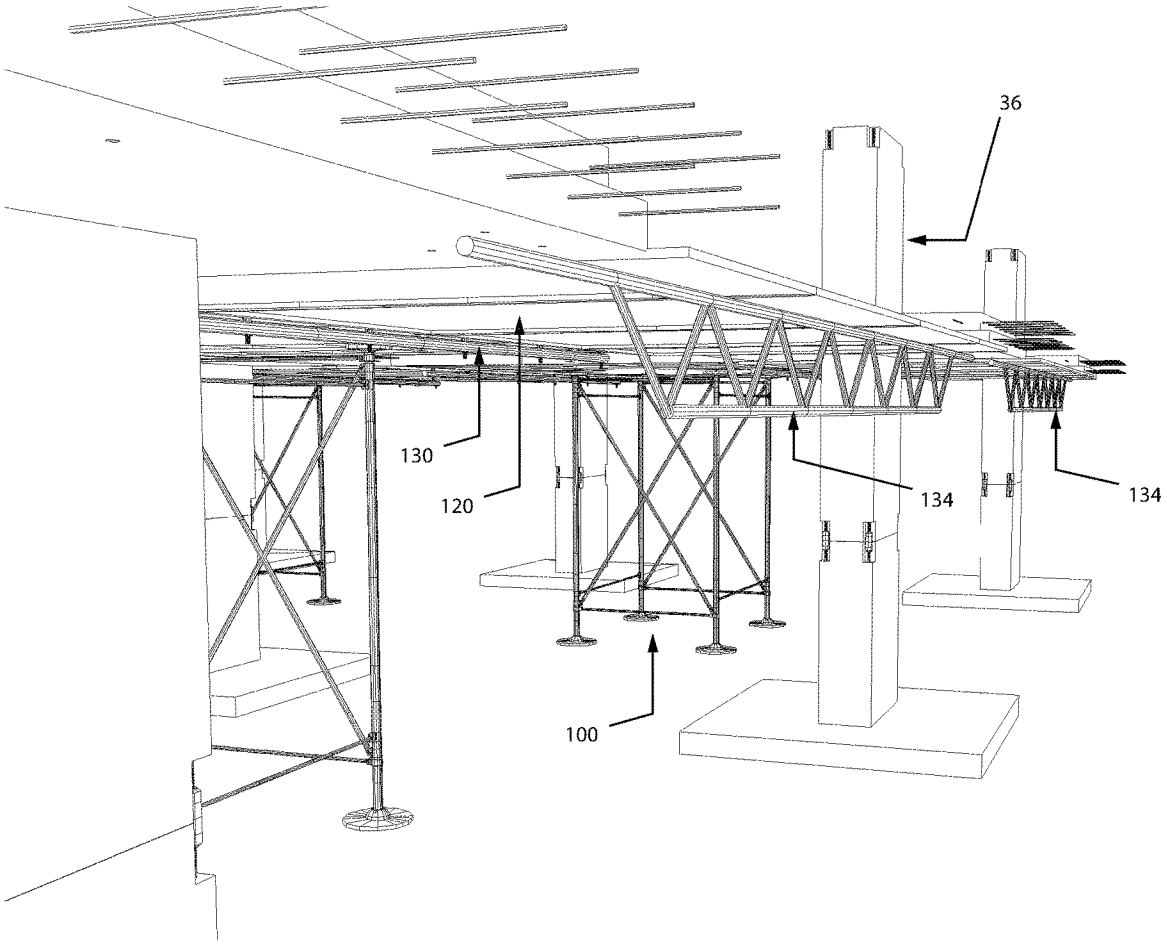
FIG. 10 illustrates an embodiment of the support trusses used to hold the position of the temporary formwork along the outer edges.

Referring to FIG. 10, an embodiment of the support trusses used to hold the position of the temporary formwork along the outer edges is shown.

The trusses 134 support the rotating formwork panels 120 along their outer edge. The trusses are affixed to the dividing slabs 36 using fasteners 132.

Figure 11:
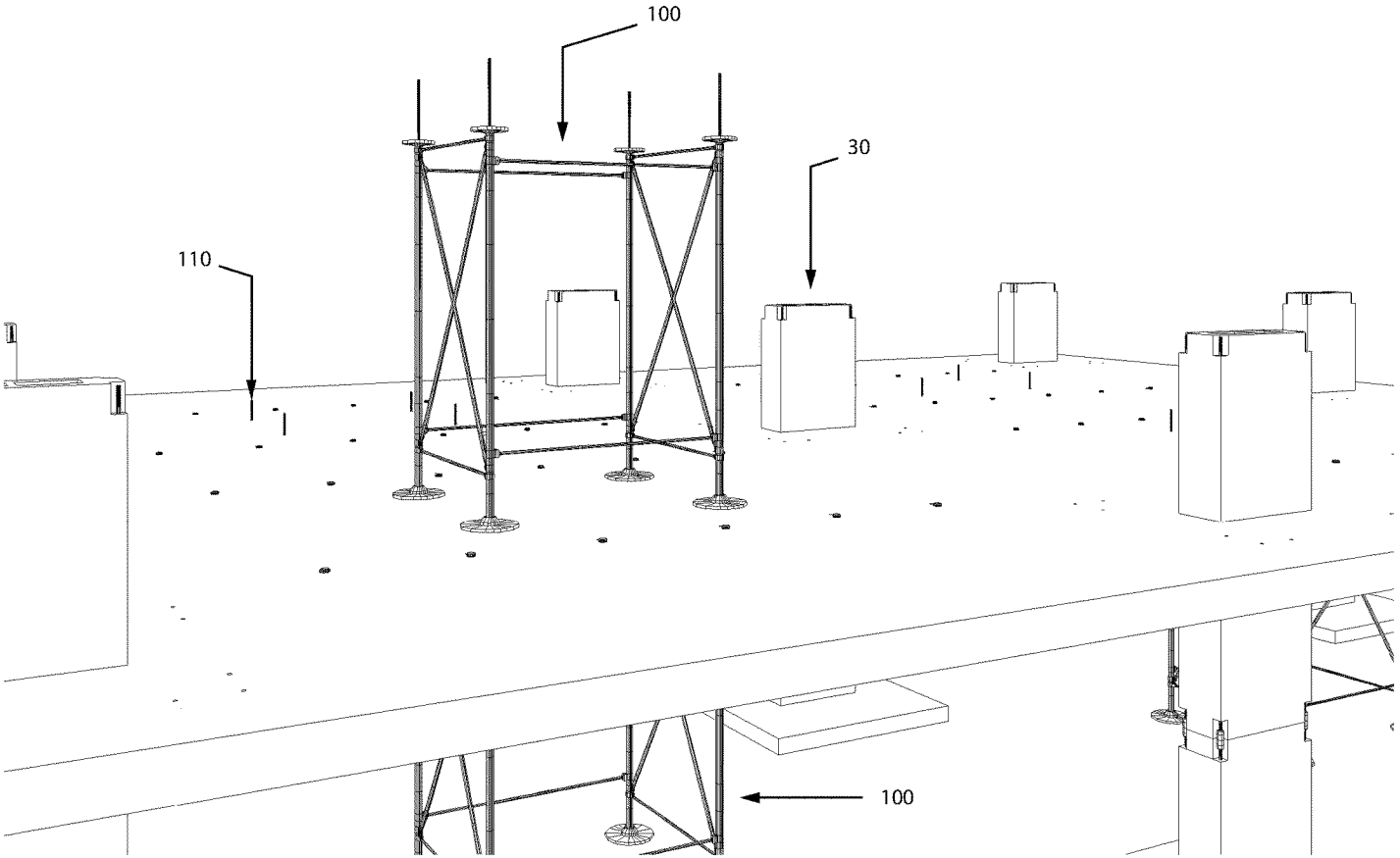
FIG. 11 illustrates the placement of a collapsible tower atop a spanning member, with a lower collapsible tower supporting the spanning member from below.

Referring to FIG. 11, the placement of a collapsible tower atop a spanning member, with a lower collapsible tower supporting the spanning member from below, is shown.

The collapsible tower 100 is in position to support a subsequently placed spanning member 60, and so construction proceeds.

Figure 12:
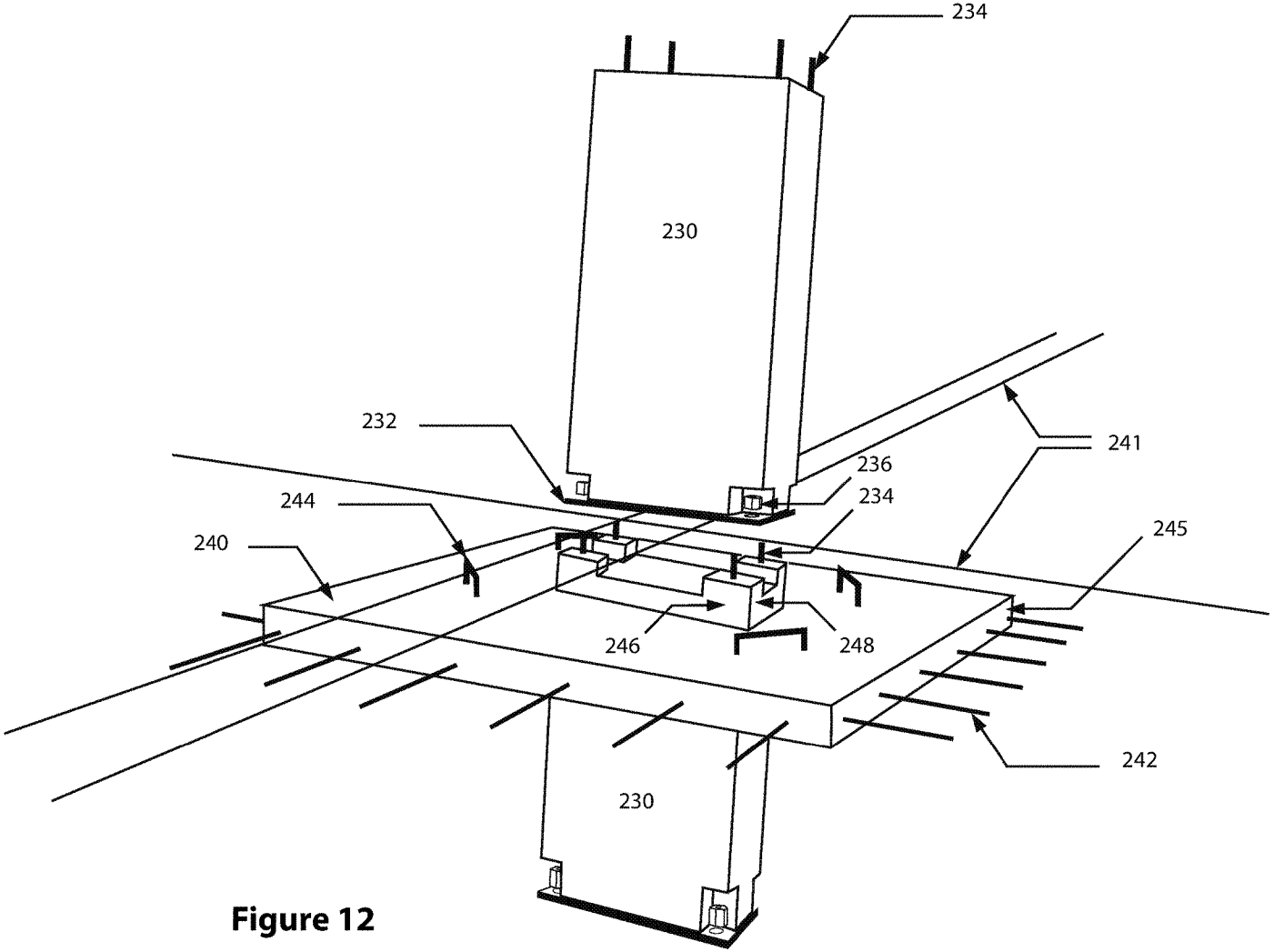
FIG. 12 illustrates a second embodiment of the precast column and slab using a nut.

Referring to FIG. 12, a second embodiment of the precast column and slab using a nut is shown.

The precast column 230 ends at the top with threaded rebar 234, and the bottom with plate 232.

The precast slab 240, primary formed from horizontal slab 245, includes an upwardly-protruding column foot 246 with multiple foot risers 248. The threaded rebar 234 of the precast column 230 below protrudes through the riser penetrations 250 (see FIG. 14), affixing to the precast column 230 above at the plate 232 using nuts 236.

The precast lower rebar 242 is placed during factory casting of the precast slab 240. The laid-in upper rebar 241 is installed after placement of the precast members, placed between the foot risers 248 and affixed to the protruding precast stirrups 244.

Figure 13:
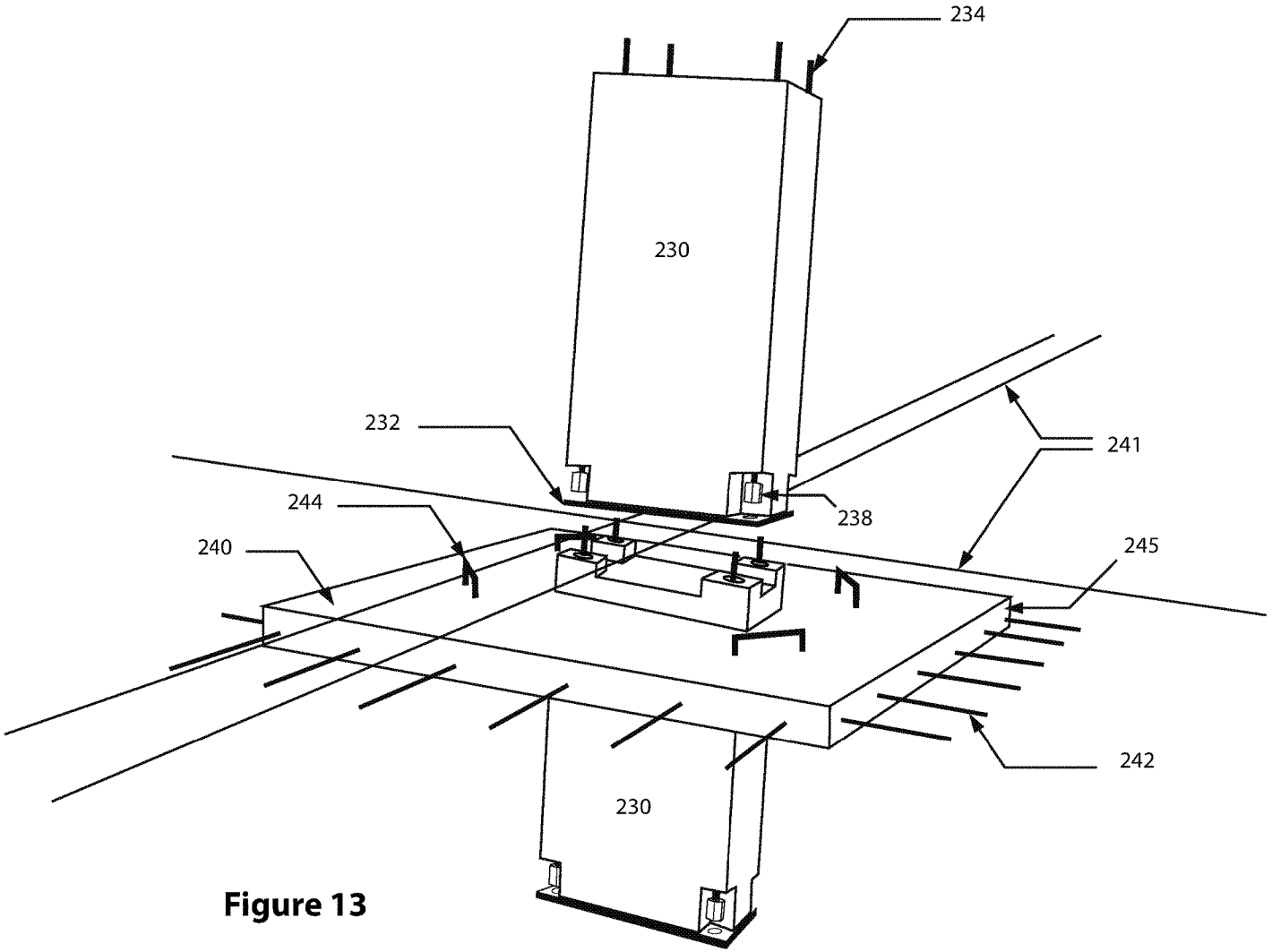
FIG. 13 illustrates a second embodiment of the precast column and slab using a threaded coupling.

Referring to FIG. 13, a second embodiment of the precast column and slab using a threaded coupling is shown.

Rather than using a nut 236 as shown in FIG. 12, a threaded coupling 238 connects the threaded rebar 234 of the precast columns 230.

Figure 14:
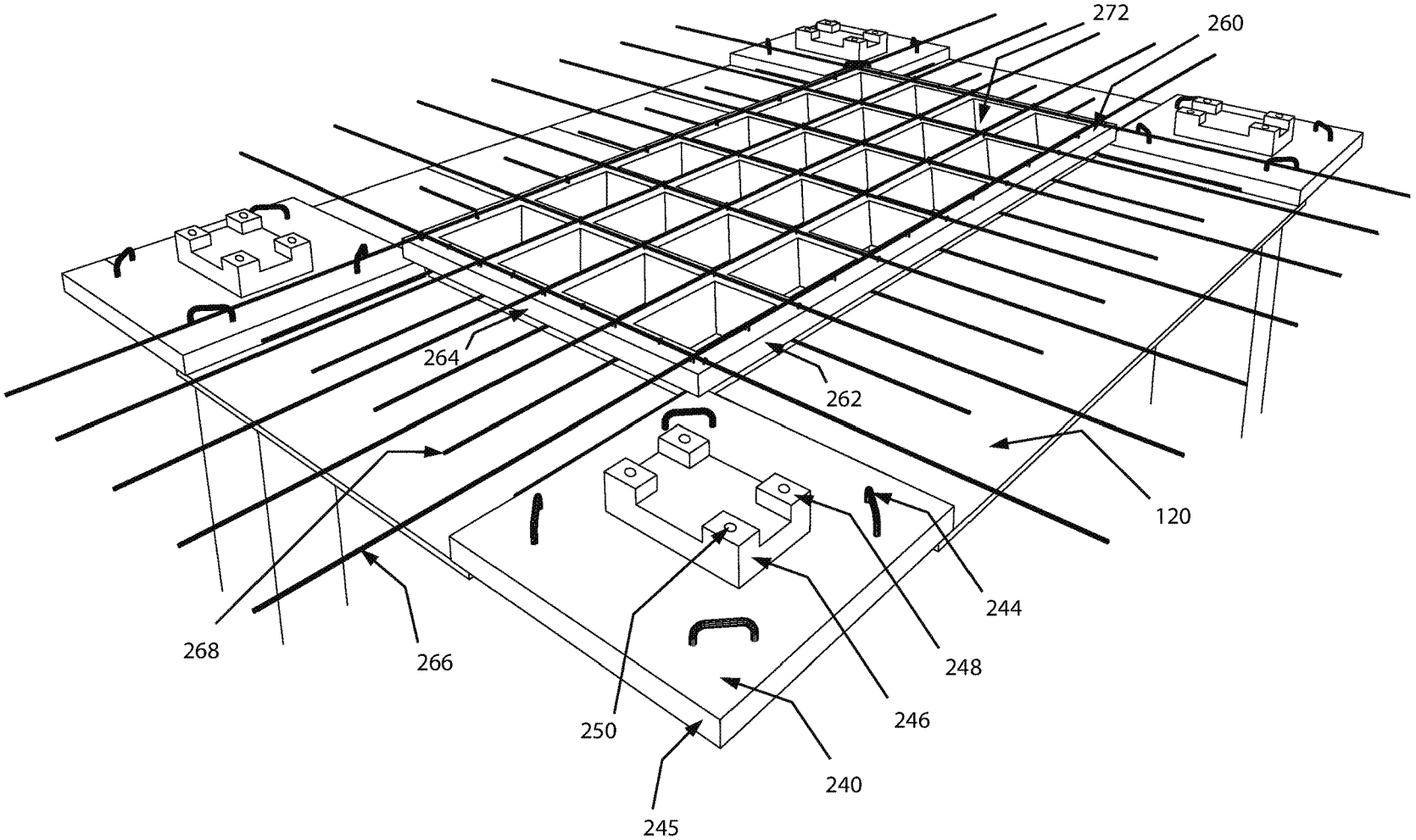
FIG. 14 illustrates a second embodiment of the precast spanning member installed between the precast column and slab, prior to pouring the cast-in-place concrete.

Referring to FIG. 14, a second embodiment of the precast spanning member installed between the precast column and slab, prior to pouring the cast-in-place concrete is shown.

The projection 264 formed from the perimeter wall 262 of the precast spanning member 260 rests on the corners of the precast slabs 240, thereby supporting the precast spanning member 260. Within the precast spanning member 260 are a plurality of individual cavities 272 that are optionally filled with a lightweight material or poured concrete.

The spanning member upper rebar 266 protrudes above the projection 264, with the spanning member lower rebar 268 protruding below the projection 264. As discussed above, this rebar will be overlapped and tied with rebar placed during construction and prior to pouring concrete.

The spanning member lower rebar 268 is optionally installed after placement of the precast spanning member 260.

Also shown are the components of the precast slab 240 that support the precast columns 230 (see FIG. 12), including the horizontal slab 245, precast stirrups 244, column foot 246, foot risers 248, and riser penetrations 250.

The rotating formwork panels 120 are visible between the precast slabs 240.

Figure 15:
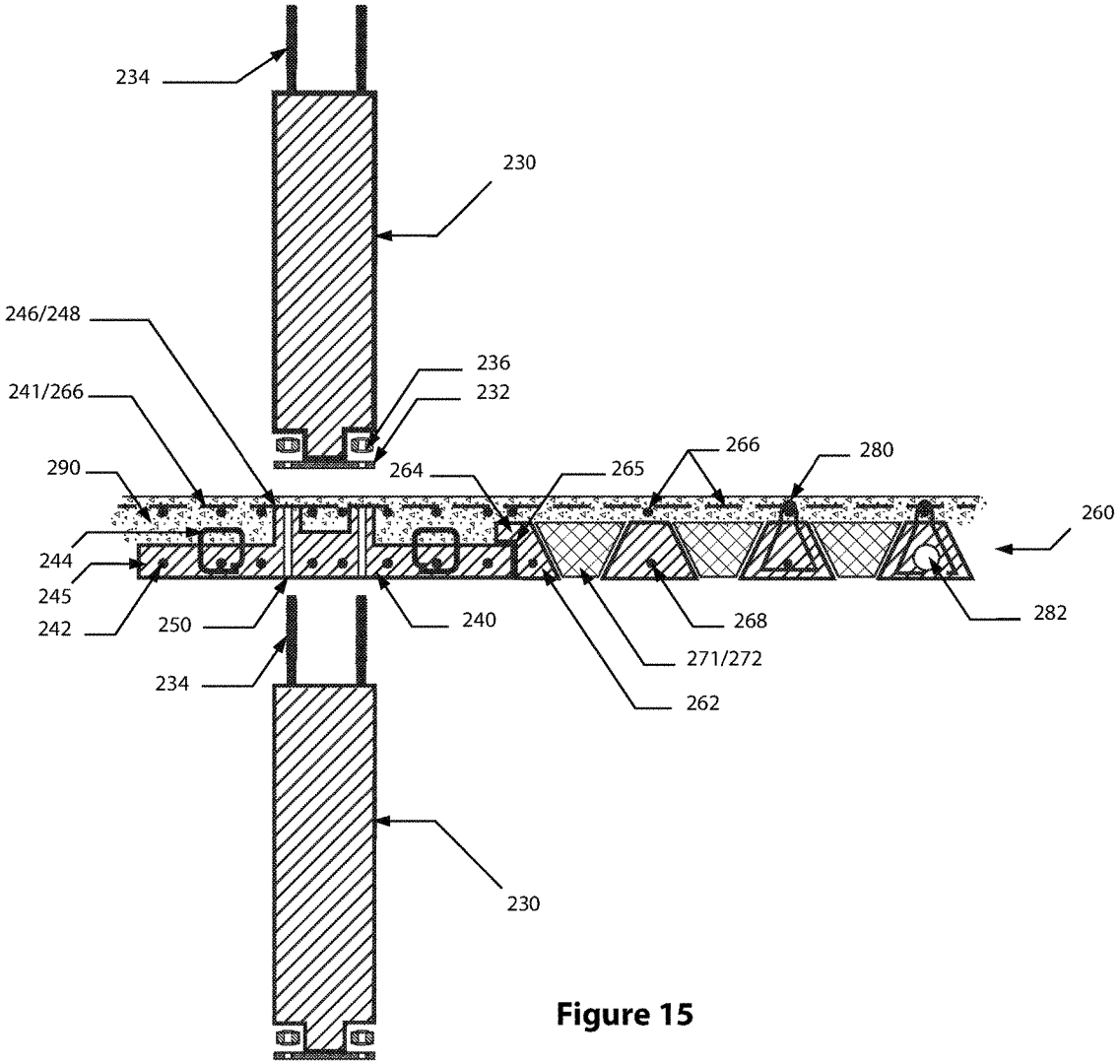
FIG. 15 illustrates a cross-sectional view of the second embodiment of the precast column, precast slab, and precast spanning member.

Referring to FIG. 15, a cross-sectional view of the second embodiment of the precast column, precast slab, and precast spanning member is shown.

During construction, the precast slab 240 is installed over a precast column 230, with the threaded rebar 234 sliding through the riser penetrations 250. The next-higher precast column 230 rests on the foot risers 248 of the column foot 246.

The nuts 236 hold the threaded rebar 234 to the plate 232, which is in turn welded to the internal rebar of the next-higher precast column 230.

The precast spanning member 260 is placed atop the precast slab 240, with the projection 264 of the perimeter wall 262 resting on top. A notch 265 creates space for the overlap.

The precast lower rebar 242 is visible within the horizontal slab 245.

The laid-in upper rebar 241 and spanning member upper rebar 266 are then placed, optionally tied to the precast stirrups 244 and spanning member stirrups 280.

In some embodiments, the precast spanning member 260 includes penetrations for rebar installation 282, through which the spanning member lower rebar 268 is installed and then grouted into place.

The multiple individual cavities 272 of the precast spanning member 260 preferably include foam cavity fillers 271 that block the flow of concrete while reducing weight.

After assembly, cast-in-place concrete 290 is poured to join the precast into a unitary structure.

Figure 16:
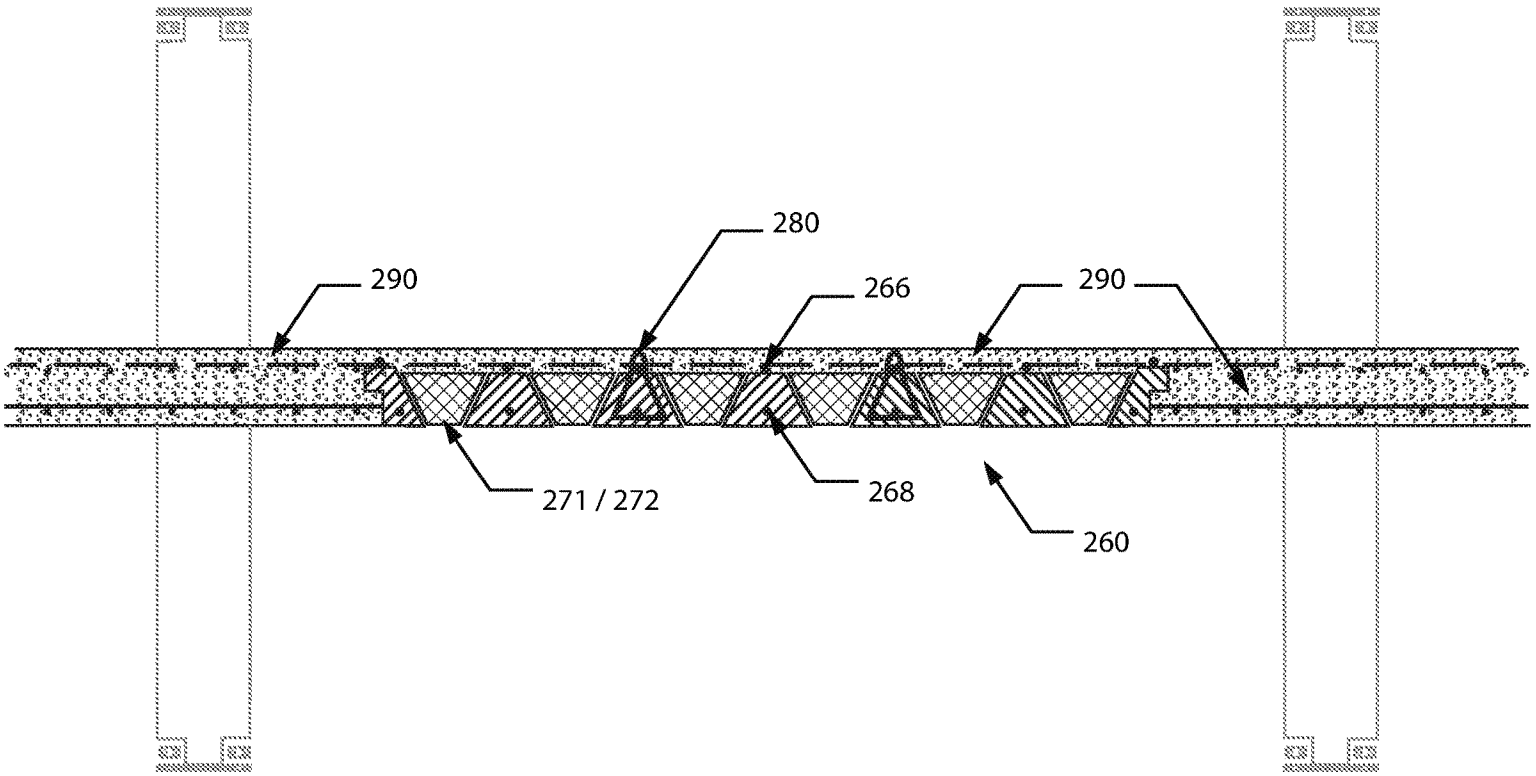
FIG. 16 illustrates a second cross-sectional view of the second embodiment of the precast column, precast slab, and precast spanning member.

Referring to FIG. 16, a second cross-sectional view of the second embodiment of the precast column, precast slab, and precast spanning member is shown.

This cross-section is through the center of the precast spanning member 260.

Again shown are the individual cavities 272 with foam cavity fillers 271. The spanning member upper rebar 266 and spanning member lower rebar 268 are seen, with spanning member stirrups 280 tying the precast spanning member 260 to the cast-in-place concrete 290.

Note that the cast-in-place concrete 290 beyond the precast spanning member 260 is full thickness because it is poured on top of the rotating formwork panel 120 (see FIG. 8) used during construction.

Figure 17:
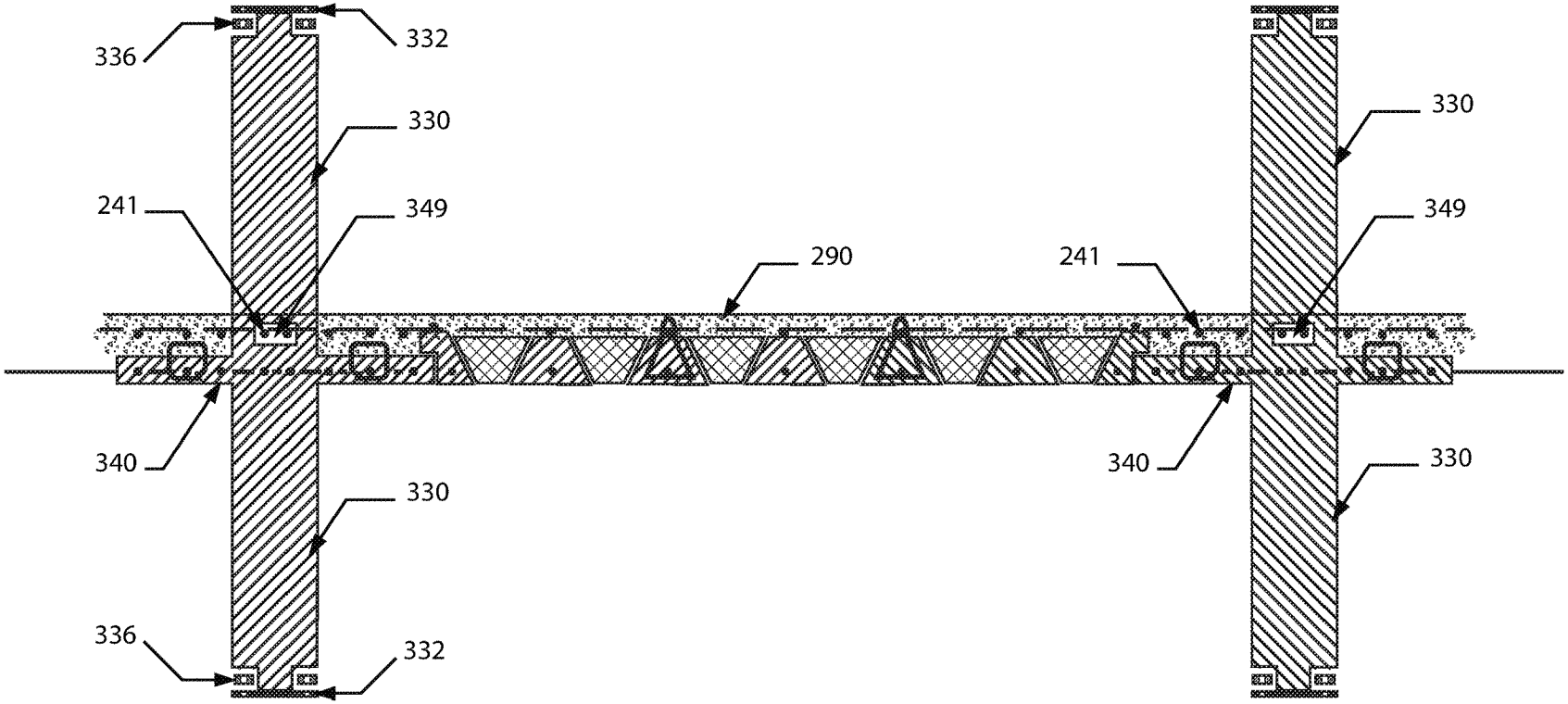
FIG. 17 illustrates a cross-sectional view of a third embodiment of the precast column, precast slab, and precast spanning member.

Referring to FIG. 17, a cross-sectional view of an alternative second embodiment of the precast column, precast slab, and precast spanning member is shown.

This embodiment is a hybrid of the first and second embodiments. The precast column 330 and precast slab 340 are a single piece, but with a rebar gap 349 for placement of the laid-in upper rebar 241.

This design reduces the number of pre-cast elements that must be placed during construction, but still permits the use of long spans of rebar.

Each precast column 330 includes a plate 332 and nut 336 to aid in attachment elements above and below the column 330.

Figure 18:
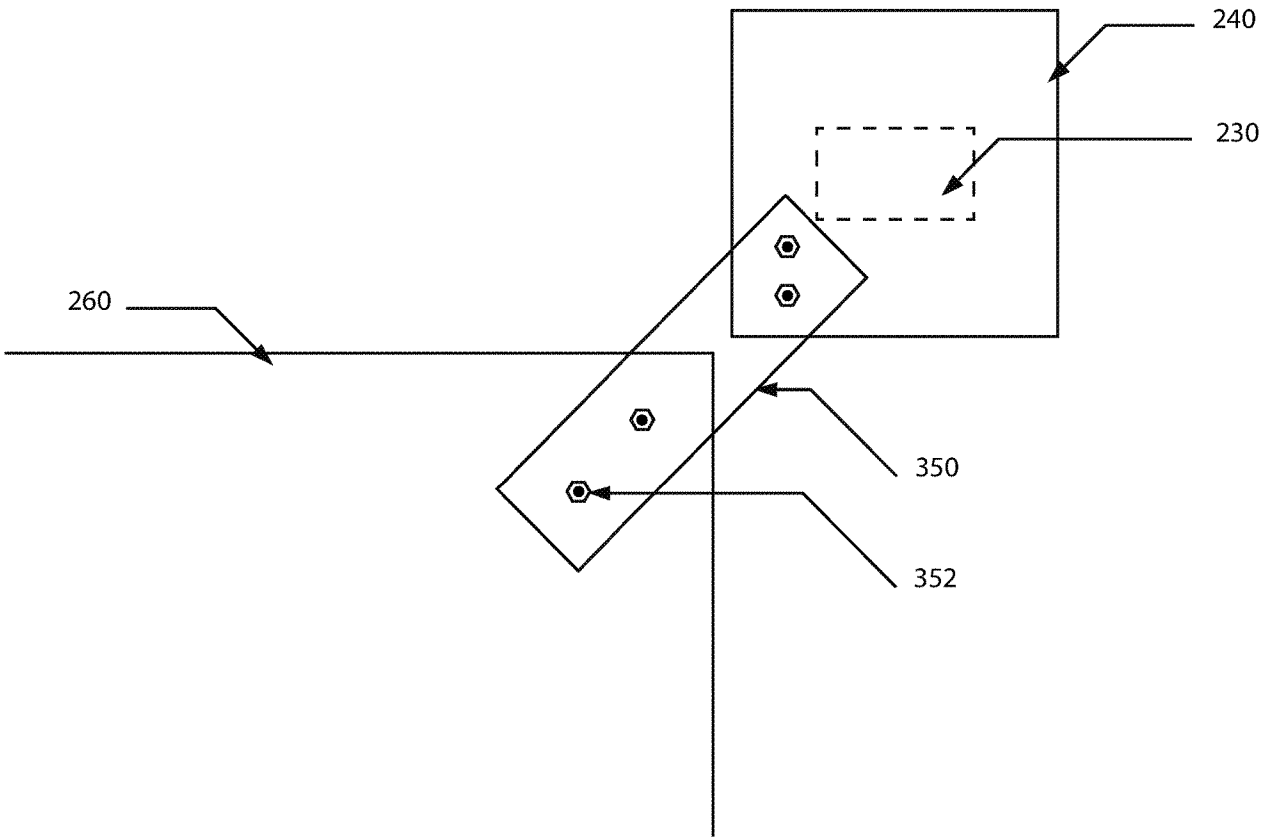
FIG. 18 illustrates a top-view of an optional temporary support structure.

Referring to FIG. 18, top-view of an optional temporary support structure is shown.

The precast spanning member 260 is shown affixed to the precast slab 240 using a metal support box 350. The metal support box 350 is connected to the precast spanning member 260 and precast slab using bolts 352.

A precast column 230 is shown above and below the precast spanning member 260.

Figure 19:
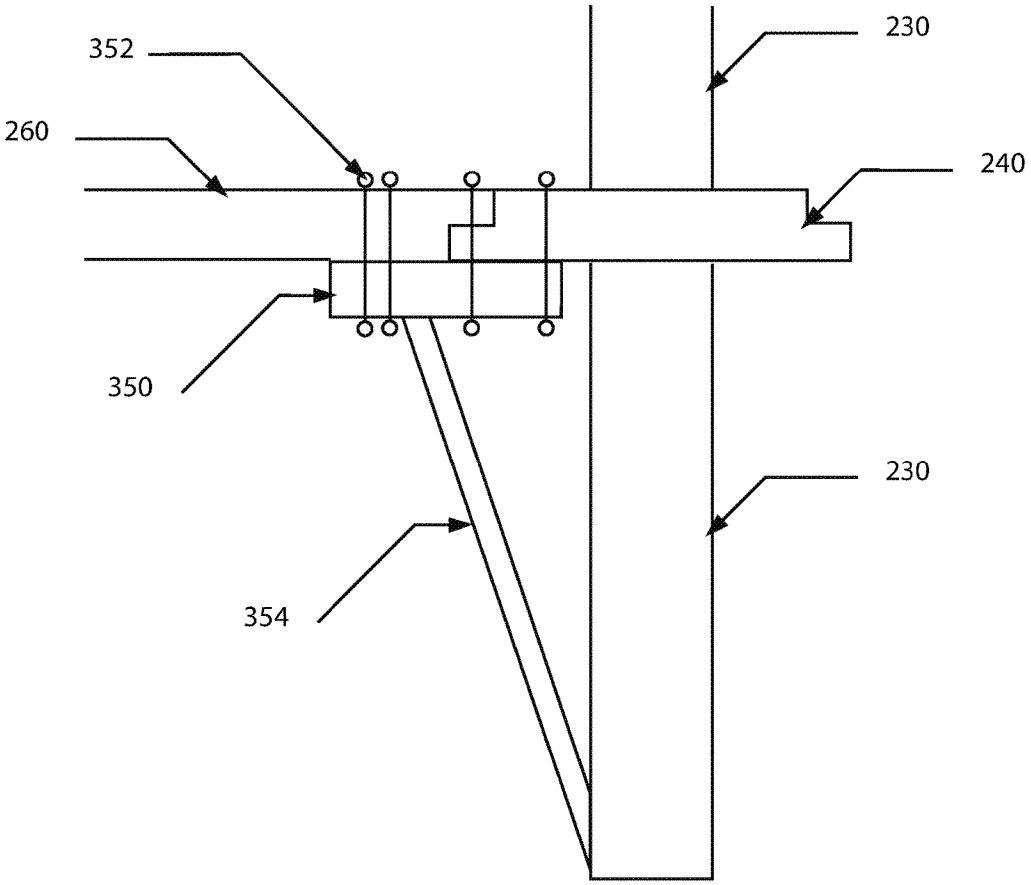
FIG. 19 illustrates a side-view of an optional temporary support structure.

Referring to FIG. 19, a side-view of an optional temporary support structure is shown.

The temporary support structure is optionally used during construction, before the concrete has been poured.

The precast spanning member 260 is again shown affixed to the precast slab 240 using a metal support box 350, held in place using bolts 352.

An additional angled metal support 354 optionally supports the metal support box 350 by bracing against the precast column 230. Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of erecting a multi-story structure, the method comprising the steps of:

excavating a building site to create an excavated surface;

placing one or more base members against the excavated surface, each base member comprising:

a horizontal slab;

placing a precast column atop each of the one or more base members, each precast column comprising:

a column portion; and one or more upwardly-protruding rebar;

placing a precast slab atop each precast column, each precast slab comprising:

a horizontal slab;

a column foot protruding from a top of the horizontal slab, one or more foot risers protruding from a top of the column foot;

placing a precast spanning member, the precast spanning member resting atop the horizontal slabs of two or more precast slabs, each spanning member comprised of:

a perimeter wall;

a multiplicity of individual cavities;

one or more formwork support rods affixed to a base of the precast spanning member;

affixing a rotating formwork panel to the one or more formwork support rods of the precast spanning member, each rotating formwork panel comprised of:

a solid panel;

fixed hooks adapted to rotate around the formwork support rods of the spanning member;

slideable hooks to affix to formwork support rods after rotation of the panel into place;

pouring concrete on top of the rotating formwork panels;

pouring concrete across the precast slabs and precast spanning members;

repeating steps "placing a precast column" through "placing a precast spanning member," each time completing a floor of the multi-story structure, stopping when the multi-story structure is the desired number of floors.

2. The method of erecting a multi-story structure of claim 1, wherein:

the base member further comprises:

a shear key receiving cavity located on top of the vertical column; and a vertical column extending from the horizontal slab;

the precast column further comprises;

a shear key located beneath the column portion;

wherein the shear key interfaces with the shear key receiving cavity when the precast column is placed atop the base member.

3. The method of erecting a multi-story structure of claim 1, wherein the spanning member further comprises:

a continuous central member upper rebar that includes a portion within the spanning member and a portion that extends beyond the spanning member; and a continuous central member lower rebar that includes a portion within the spanning member and a portion that extends beyond the spanning member.

4. The method of erecting a multi-story structure of claim 1, wherein the multiplicity of individual cavities of the spanning member further comprise:

a lightweight fill material that substantially fills the individual cavities.

5. A hybrid precast and cast-in-place concrete building system comprising:

an upper precast column and a lower precast column, each comprising:

a column portion;

one or more upwardly-protruding rebar;

a bottom-mounted metal connection plate with penetrations; and a precast slab comprising:

a horizontal slab;

a column foot protruding from a top of the horizontal slab;

one or more foot risers protruding from a top of the column foot, thus creating space for the later placement of rebar;

each of the one of more foot risers surrounding a riser penetration;

whereby, during assembly the precast slab is placed on top of the lower precast column, the upwardly-protruding rebar of the lower precast column passing through the riser penetrations, and through the bottom-mounted metal connection plate of the upper precast column, after which concrete is poured on top of the precast slab, thereby creating a hybrid precast and cast-in-place structure.

6. The system of claim 5, wherein the upwardly-protruding rebar of the upper precast column and lower precast column is threaded, thereby permitting the use of nuts to mechanically connect the upper precast column to the lower precast column.

7. The system of claim 5, further comprising:

a precast spanning member comprising:

a multiplicity of individual cavities;

a perimeter wall surrounding the individual cavities;

a projection extending from the perimeter wall;

whereby the precast spanning member rests upon two or more precast slabs, the projection interlocking with the horizontal slab to support the precast spanning member, and following placement, concrete is poured on top of the precast spanning member and precast slabs, thereby creating the hybrid precast and cast-in-place structure.

8. The system of claim 6, wherein the precast spanning member further comprises:

a lightweight fill material that substantially fills the multiplicity of individual cavities.

9. A method of erecting a multi-story structure, the method comprising the steps of:

excavating a building site to create an excavated surface;

placing one or more base members against the excavated surface, each base member comprised of:

a horizontal slab;

a vertical column extended from the horizontal slab;

placing a precast column atop each vertical column of each of the one or more base members, each precast column comprising:

a column portion; and one or more upwardly-protruding rebar;

placing a precast slab atop each precast column, each precast slab comprising:

a horizontal slab;

a column foot protruding from a top of the horizontal slab;

one or more foot risers protruding from a top of the column foot;

placing a precast spanning member, the precast spanning member resting atop the horizontal slabs of two or more precast slabs, each spanning member comprised of:

a perimeter wall;

a multiplicity of individual cavities;

one or more formwork support rods affixed to a base of the precast spanning member;

hanging a rotating formwork panel from one formwork support rods of the spanning member, each rotating formwork panel comprised of:

a solid panel;

fixed hooks adapted to rotate around the formwork support rods of the spanning member;

slideable hooks to affix to formwork support rods after rotation of the panel into place;

lifting the rotating formwork panel into a horizontal position;

sliding the slideable hooks of the rotating formwork panel into an adjacent formwork support rod;

pouring concrete on top of the rotating formwork panels, thereby filling the spaces between the precast slabs and precast spanning member;

pouring concrete into the multiplicity of individual cavities of the precast spanning member, thereby filling the individual cavities;

repeating the steps of "placing a precast column" through "pouring concrete into the multiplicity of individual cavities" each time completing a floor of the multi-story structure, stopping when the multi-story structure is the desired number of floors.

10. The method of erecting a multi-story structure of claim 9, wherein:

the base member further comprises:

a shear key receiving cavity located on top of the vertical column; and the precast column further comprises;

a shear key located beneath the column portion;

wherein the shear key interfaces with the shear key receiving cavity when the central member is placed atop the base member.

11. The method of erecting a multi-story structure of claim 9, wherein the spanning member further comprises:

a continuous central member upper rebar that includes a portion within the spanning member and a portion that extends beyond the spanning member; and a continuous central member lower rebar that includes a portion within the spanning member and a portion that extends beyond the spanning member.

* * * * *